United States Patent [19]

Kawai et al.

[11] Patent Number: 4,644,996

[45] Date of Patent: Feb. 24, 1987

[54] INCLINING MOLTEN METAL CHARGING APPARATUS FOR FORCED COOLING CASTING

[75] Inventors: Hiroshi Kawai; Yukio Ohtsuka; Kuniaki Mizuno, all of Toyota, Japan

[73] Assignee: Toyota Jidosha Kabushiki Kaisha, Toyota, Japan

[21] Appl. No.: 818,675

[22] Filed: Jan. 14, 1986

[51] Int. Cl.[4] ..... B22D 15/00

[52] U.S. Cl. ..... 164/336; 164/126; 164/348

[58] Field of Search ..... 164/122, 122.1, 122.2, 164/126, 127, 128, 133, 136, 134, 336, 348, 353, 354, 356, 362, 371, 373, 185, 409

[56] References Cited

U.S. PATENT DOCUMENTS 2,186,938 1/1940 McWane ..... 164/336
4,585,047 4/1986 Kawai et al. ..... 164/348

FOREIGN PATENT DOCUMENTS 57-109559 12/1980 Japan .
58-86966 11/1981 Japan .

*Primary Examiner*—Nicholas P. Godici
*Assistant Examiner*—G. M. Reid
*Attorney, Agent, or Firm*—Oblon, Fisher, Spivak, McClelland & Maier

[57] ABSTRACT

An inclining molten metal charging apparatus for forced cooling casting which includes a fixed frame; an inclining frame pivotally supported by the fixed frame and reciprocatingly inclined at a predetermined angle; a stool having positioned on and fitted thereon a casting mold, a plurality chillers used for directional solidification and a tubular member internally chilled as a functional component such as a bolt fastening hole in a resulting casting; a stool support mechanism for carrying the stool into and out from a space defined by the inclining frame; a clamp mechanism for having a function of clamping the stool at a predetermined position inside the space, and equipped with a push member for pushing the casting mold to the stool when the clamp mechanism effects clamping; a molten metal vessel receiving a molten metal at the end of the forward stroke of the inclining frame and completing the charge of the molten metal into the casting mold at the end of the returning stroke; a cooling nozzle fitted to the tubular member by operation of the clamp mechanism; a chiller cooling mechanism for blowing a cooling medium to the chillers; and a cooling medium tank for collecting and storing the cooling medium after it is used.

8 Claims, 4 Drawing Figures

INCLINING MOLTEN METAL CHARGING APPARATUS FOR FORCED COOLING CASTING

BACKGROUND OF THE INVENTION

Field of the Invention

This invention relates to an inclining molten metal charging apparatus for forced cooling casting which uses chillers as forced cooling means for promoting directive solidification of castings, and moreover uses a tubular member as the forced cooling means when a through-hole(s) to be used for fastening a resulting casting by a bolt or the like is formed by internally chilling the tubular member in the casting.

DISCUSSION OF THE BACKGROUND

In order to produce aluminum alloy castings such as aluminum cylinder heads devoid of any structural defects such as pin-holes and cracks and having high strength and reliability, it is essential that solidification of molten metal be made quickly and the molten metal be solidified directionally (i.e. directional solidification occurs). In conventional gravitational casting methods and low pressure casting methods, it has been customary to promote the solidification of the molten metal by cooling a casting mold with water or air. However, it is necessary in this case to adjust the mold temperature relatively strictly lest run defects of the molten metal occur due to over-cooling of the mold when the molten metal is charged. Since the mold temperature periodically changes with casting cycles, however, a relatively high control technique is necessary for temperature control of the casting mold. If cooling means are incorporated in the casting mold, the structure of the mold becomes more complicated and the cost of the mold becomes correspondingly higher.

To effect directive solidification for the purpose of eliminating structural defects, the position of installation and the shape and capacity of a hot top have been selected and set empirically. However, the selection is limited by the shape of castings to be obtained, and hence satisfactory directive solidification can not be attained from time to time by means of the hot top alone.

In addition, in accordance with conventional casting methods, the solidification rate of the molten metal is low and the mechanical strength of the resulting castings is also low.

Therefore, the Applicant of the present invention previously proposed a direct cooling type casting method of casting (Japanese Patent Laid-Open No. 109559/1982) which provides a casting with an excess metal portion at the time of casting so that solidification occurs from the portions close to this excess metal portion, and forcedly cools the excess metal portion so as to promote directional solidification. This direct cooling type casting method of casting promotes directional solidification, improves the quality of resulting castings and shortens the casting cycle.

The Applicant also proposed previously a forced cooling casting method (Japanese Patent Laid-Open No. 86966/1983) which disposes a tubular member, which is to be internally chilled in a resulting casting as a functional component whose hollow portion is to be used as a bolt fastening hole of the casting, for example, and passes a cooling medium through this tubular member to forcedly cool the molten metal and to promote solidification. This forced cooling casting method increases the solidification rate of the molten metal, improves the mechanical strength of the resulting casting and shortens the casting cycle.

In accordance with the direct cooling type casting method of castings described above, however, the yield of the resulting castings is less because the excess metal portion is disposed of, and removal of the excess metal portion after casting is very time-consuming.

In accordance with the forced cooling casting method, on the other hand, directional solidification can not be accomplished sufficiently depending upon the shape of castings when large-scale castings such as cylinder heads are to be obtained.

For the reasons described above and to eliminate these problems, the Applicant of the invention proposed a forced cooling casting method (not yet disclosed) which utilizes chillers, which have often been used in the past, for directive solidification and utilizes also a tubular member, which is to be internally chilled in a resulting casting by a molten metal, for forced cooling.

In the method which passes a cooling medium through the tubular member and utilizes the tubular member for forced cooling, a cooling nozzle for supplying the cooling medium is fitted into the tubular member and supplies the cooling medium from the cooling nozzles into the tubular member. Therefore, unless the cooling nozzle fits the tubular member tightly, the cooling medium will leak, and it has been necessary to develop a method which can tightly and quickly fit the cooling nozzle to the tubular member.

It has also been desired to develop a forced cooling casting apparatus which can carry out quickly and accurately each of a series of casting processes such as charging of a molten metal, forced cooling, and the like.

SUMMARY OF THE INVENTION

It is an object of the present invention to provide an inclining molten metal charging apparatus for forced cooling casting which can fit tightly and quickly a cooling nozzle to a tubular member and can carry out quickly and accurately each step of a series of casting processes in a forced cooling casting method.

The inclined molten metal charging apparatus of the present invention to accomplish the object described above comprises a fixed frame; an inclining frame pivotally supported by the fixed frame and reciprocatingly inclined by a predetermined angle; a stool to which a casting mold, a chiller disposed in such a manner as to race the cavity of the casting mold and a tubular member disposed in such a manner as to pass through the cavity and to be internally chilled in a resulting casting as a functional component are located and fitted; stool support means for carrying the stool in and out from a space defined by the inclining frame; clamp means having a function of clamping the stool at a predetermined position inside the space described above, and including push means for pushing the casting mold towards the stool when the clamp means effects clamping; a molten metal vessel fixed to the inclining frame in such a manner that the molten metal inlet thereof faces a molten metal port of the casting mold, receiving the molten metal at the end of the forward movement of the inclining frame and completing the charge of the molten metal into the casting mold at the end of the return movement the inclining frame; a cooling nozzle disposed in such a manner that the tip thereof corresponds to the upper end of the tubular member when the stool is at the predetermined position, and which is fitted to the upper end of the tubular member by the clamp operation of the clamp means; chiller cooling means disposed in such a manner as to be capable of blowing a cooling medium to the chillers in order to cool the chillers; and a cooling medium tank for storing a cooling medium passing through the tubular member and a cooling medium blown to the chillers.

In accordance with the present invention, when the clamp means is supported by the stool support means and is actuated while the stool is carried into the space defined by the inclining frame, the top of the cooling nozzle fits or the upper end portion of the tubular member with the clamp of the stool at the predetermined position in the space. Moreover, the connection of the cooling to the tubular member can be accurately and quickly made because the cooling nozzles are located in such a manner that the tip portion thereof corresponds to the upper end portion of the tubular member when the stool is at the predetermined position.

Next, the molten metal vessel is arranged in such a manner that its molten metal inlet faces the molten metal port of the casting mold when the mold is at the predetermined position. Therefore, the charging operation of the molten metal can be started immediately after completion of the clamping operation of the clamp means. The molten metal vessel is arranged so that it receives the molten metal at the end of the forward movement of the inclining frame and finishes the charge of molten metal at the end of the return movement. Therefore, charging operation of the molten metal can be accomplished extremely quickly. Since the molten metal vessel and the casting mold incline integrally with each other, their molten charge inlet and molten metal port do not come away from each other; therefore, the molten metal does not leak from between them. Moreover, since the casting mold is pushed to the stool by the push means during its inclining operation, the molten metal does not leak from the joint surface of the cope and drag of the casting mold and the charging operation of the molten metal is extremely accurate.

The cooling nozzle has already been connected to the tubular member before the stool is clamped, and the chiller cooling means is disposed in such a manner as to be capable of blowing the cooling medium to the chillers. Therefore, the forced cooling step can be carried out immediately after completion of the reciprocating inclination of the inclining frame (that is, the completion of the charging operation of the molten metal), and hence this forced cooling step can be carried out quickly, too.

If the stool support means consists of a conveyor roller for defining a moving path of the stool, a stopper member abutting the front portion of the stool when the stool is carried into the space and guide rollers coming into rolling contact with both sides of the stool on both sides of the conveyor rollers, the stool can be positioned on the clamp means to some extent, so that the clamping operation can be carried out smoothly. If the stopper is retractable with respect to the moving path of the stool and is withdrawn from its region when the stool is carried out, the moving direction of the stood can be made the same when it is carried in and when it is carried out. Therefore, the stool can be carried in and out smoothly.

If the stool is equipped with at least two guide pins projecting upwards and if the clamp means consists of a main body supported by the inclining frame and moved up and down in the space defined by the inclining frame and guide bushes disposed in such a manner as to correspond to the guide pins, fixed by the main body and fitting to the guide pins when the main body moves downward, the stool can be fixed more reliably to the inclining frame.

Furthermore, if the push means consists of a repelling spring, leakage of molten metal from the joint surface of the casting mold can be prevented more reliably by selecting a suitable driving force for the spring.

If the molten metal vessel is equipped with slag removing means, the quality of the resulting castings can be improved by preventing the entrance of the slag into the casting mold. This slag removing means consists, for example, of a weir disposed close to the molten metal inlet.

The cooling medium can be discarded or circulated automatically by furnishing the cooling medium tank with a cooling medium discharge pipe.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein:

FIGS. 1 through 3 are front views showing an inclining molten metal charging apparatus for forced cooling casting in accordance with one embodiment of the present invention, wherein:

FIG. 1 shows the state before clamping;

FIG. 2 shows the state at the time of clamping; and

FIG. 3 shows the inclined state after clamping.

DESCRIPTION OF THE PREFERRED EMBODIMENTS

Hereinafter, preferred embodiments of the present invention will be described with reference to the accompanying drawings.

Figure 4:
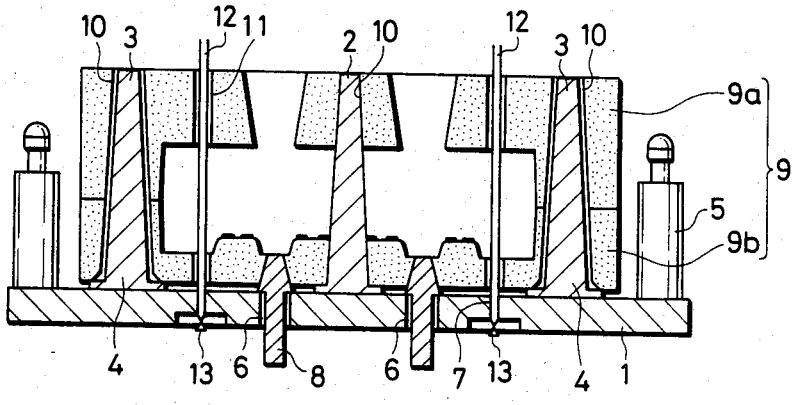
FIG. 4 is a sectional view showing a stool equipped with a casting mold which is carried into the inclining molten metal charging apparatus for forced cooling casting in accordance with one embodiment of the present invention.

Referring initially to FIG. 4, reference numeral 1 represents a stool having a rectangular flat sheet-like shape. Three positioning pins 2, 3, 3 are implanted and fixed onto the stool 1. These positioning pins 2, 3, 3 are disposed at those positions which correspond to the apexes of an imaginary equilateral triangle described arbitrarily on the stool. The pin disposed at the position corresponding the apex at which the two equilaterals cross each other is a round pin 2 having a round cross-section while the other two positioning pins are square pins 3, 3, each having a rectangular cross-section. A mold horizontal positioning seat 4 for positioning a mold in a horizontal plane is disposed below these positioning pins 2, 3, 3. The round pin 2 has a conical shape whose diameter progressively decreases upwards, while each square pin 3 has a pyramid-like shape whose cross-section similarly progressively decreases upwards.

A pair of guide pins 5 are fitted at positions close to both ends of the stool 1 in its longitudinal direction. A plurality of holes are bored on the stool 1 for chillers which forcedly cools a molten metal and for fitting a plurality of tubular members. In this embodiment, five holes 6, are provided for each of the chillers and the tubular members. The chillers 8 are fitted into these holes 6.

A sand mold 9 as a casting mold is inserted to these positioning pins 2, 3, 3 of the stool 1, and position and mold adjustment are then effected. The sand mold 9 consists of a cope 9*a* and a drag 9*b*, and locating pin holes 10 are bored in the cope 9*a* and in the drag 9*b* at positions corresponding to the locating pins 2, 3, 3, respectively. Among the locating pin holes, the hole corresponding to the round pin 2 has substantially the same size as the round pin while the holes corresponding to the square pins 3 have the same length as the square pins in the transverse direction of the stool 1 and are longer than the square pins 3 in the longitudinal direction. In other words, these holes have an elongated cross-section. A hole 11 for a tubular member is bored on the sand mold in order to insert a tubular member 12. The tubular member 12 is inserted into the hole 11. The lower end of the tubular member is supported by the ridge of a receiving bed 13 which has a substantially triangular crosssection and is mounted on the stool 1.

Figure 1:
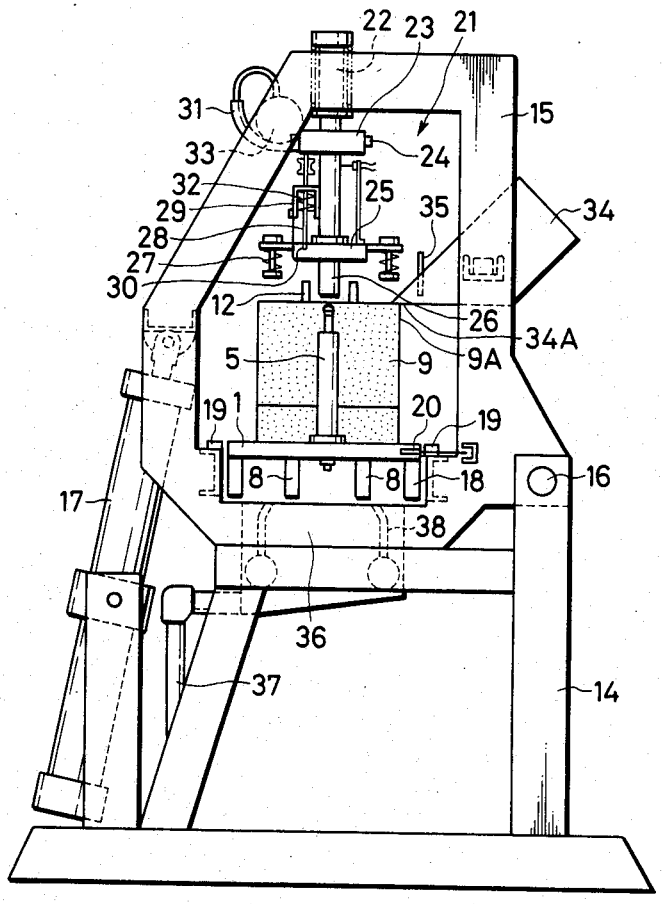

Next, an inclining molten metal charging apparatus for forced cooling casting in accordance with the present invention will be described. Referring to FIG. 1, reference numeral 14 represents a fixed frame which is assembled in a substantially rectangular shape and is fixed to a floor. An inclining frame 15 is mounted to this fixed frame 14. The inclining frame 15 is pivotally supported by the fixed frame 14 through a rotary shaft 16, and an inclining cylinder 17 as inclination driving means is rotatably fitted to a part of the fixed frame 14 on the opposite side to the rotary shaft 16. The tip of a rod of the inclining cylinder 17 is connected to part of the inclining frame 15. Therefore, the inclining frame 15 can be inclined freely by a predetermined angle by the inclining cylinder 17 with the rotary shaft 16 being the center.

The stool 1 equipped with the mold described already is carried into and out from the space defined by the inclining frame 15. A conveyor roller 18 is disposed below the inclining frame 15 so as to transfer the stool 1 on this conveyor roller 18. Guide rollers 19 as support means for restricting the movement of the stool 1 in a direction crossing the transfer direction of the stool 1 at right angles, and a stopper 20 for stopping the movement of the stool 1 is disposed at a position which is substantially the same as that of the stool, in such a manner as to be able to be retracted freely. The covneyor roller 18, the guide roller 19 and the stopper 20 together constitute stool support means.

Clamp means 21 is fitted to an upper portion of the inclining frame 15. This clamp means 21 will be explained below. A clamp cylinder 22 is vertically fitted to an upper portion of the inclining frame 15 in such a manner as to face downwards, and a clamp plate 23 is fitted to the tip of the clamp cylinder 22. A support pin 24 is inserted through the clamp plate 23 and supports a cooling plate main body 25 in a floating state. A plurality guide bushes 26 are disposed on the cooling plate main body 25 at positions corresponding to the guide pins 5 on the side of the stool 1, and push means 27 for pushing the stool 1 towards the mold 9 and supporting it is also provided.

A hole for inserting the tubular member 12 is formed at a position corresponding to the tubular member hole 11 of the sand mold 9. A sleeve 28 for a cooling nozzle is fitted to the upper surface of the cooling plate main body 25 in such a manner as to correspond to this hole. A protective case 29 is fitted to an upper part of this sleeve 28 so as to set a spring and to support and guide the upper portion of the cooling nozzle main body. A cooling nozzle 30 is slidably inserted into this sleeve 28. The cooling nozzle 30 is connected to a conduit 31 for introducing a cooling medium. A flange is formed near the center of the cooling nozzle main body, and a compression spring 32 is interposed between the flange and the protection case 29 around the outer periphery of the cooling nozzle 30. The tip of the cooling nozzle 30 has a conical shape, and the diameter of the main body of the cooling nozzle 30 is substantially the same as that of the tubular member 12. Therefore, when the tip of the cooling nozzle 30 is inserted into the tubular member 12, the cooling nozzle 13 abuts the tubular member 12 while its tip is completely inserted. Incidentally, the conduit 31 is connected to a cooling medium supply head 33.

A bill-like molten metal vessel 34 is fixed to the side of the inclining frame 15 with its tip facing the molten metal inlet of the mold 9. Reference numeral 34A represents the inlet which faces a port 9A of the mold 9. A weir 35 for removing slag is disposed inside the molten metal vessel 34.

A cooling medium tank 36 for a cooling medium is disposed on the fixed frame 14 below the bottom of the inclining frame 15, and the cooling medium inside the cooling medium tank 36 is discharged outside the apparatus through a cooling medium discharge pipe 37. Furthermore, a cooling nozzle 38 as cooling means for cooling the chillers 8 is disposed inside the cooling medium tank 36.

Next, the operation of the inclining molten metal charging apparatus for forced cooling casting in accordance with the present invention will be described. The stool 1 to which the casting mold 9, the chillers 8 and the tubular member 12 are fitted is transferred by the conveyor roller 18 into the inclining frame 15. The stool 1 is guided at its side portions by the guide rollers 19, and is stopped by the stopper 20 at a predetermined position. Thus, preliminary (i.e. tentative) position adjustment is made. After the preliminary position is adjusted, the upper clamp means 21 is actuated. In other words, the clamp cylinder 22 starts extending to move down the cooling plate main body 25. Then, the guide bush 26 and the guide pin 5 mesh with each other, thereby positioning the cooling plate main body 25 on the stool 1. At the same time, the tip of the cooling nozzle 30 enters the tubular member 12 and is fitted thereto. The upper surface of the casting mold 9 is simultaneously pushed to and supported by the push member 27.

Figure 2:
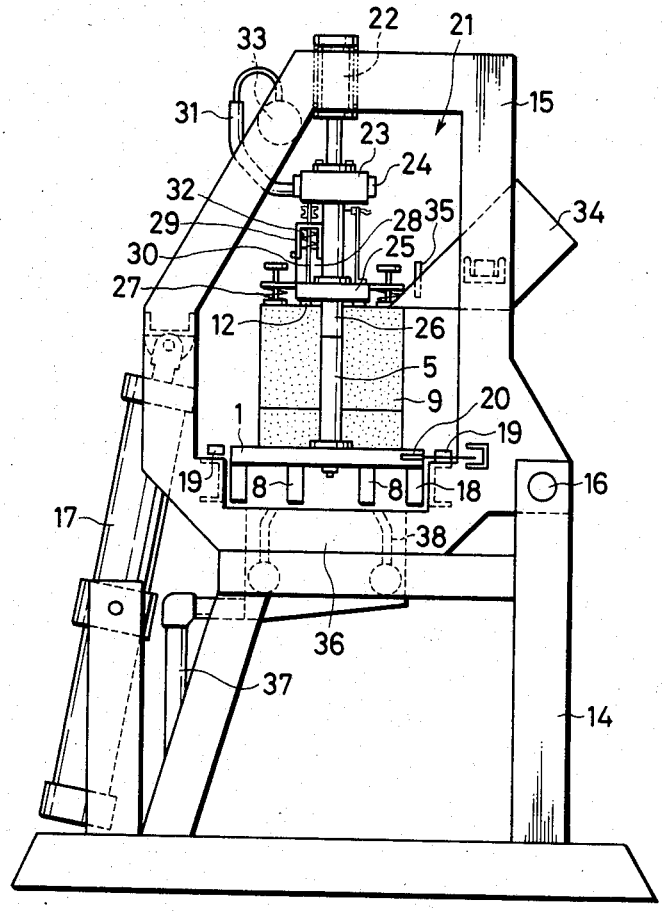
Figure 3:
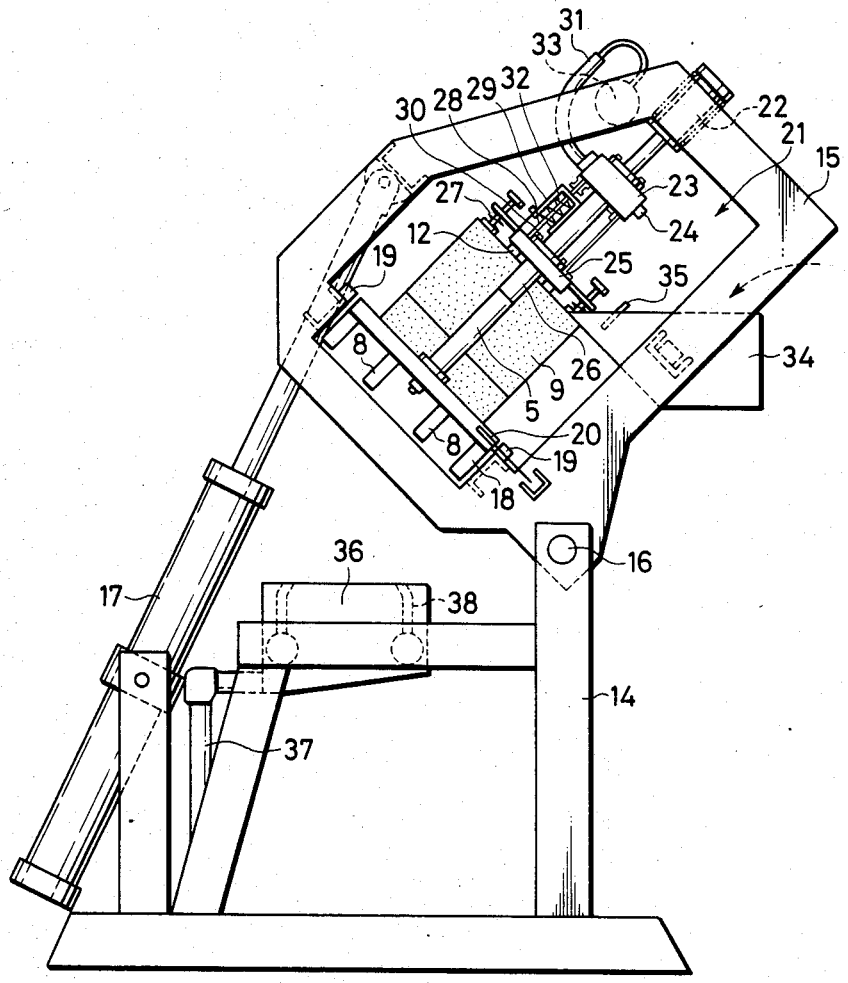

Subsequently, the inclining cylinder 17 is actuated so that the inclining frame 15 is inclined with the rotary shaft 16 being the center until the upper surface of the molten metal vessel 34 becomes substantially horizontal as shown in FIG. 3. In this state, a predetermined quantity of a molten metal is poured into the molten metal vessel 34. Next, the inclining cylinder 17 is again actuated to release the inclination, whereby both the inclining frame 15 and the molten metal vessel 34 incline simultaneously and return to the state shown in FIG. 2. During this inclination movement process impurities (oxide films, etc.) of the surface of the molten metal inside the molten metal vessel 34 are removed by the slag removing weir 35, and only the clean molten metal is poured into the product cavity or the casting mold 9. Immediately after the charging of the molten metal, the cooling medium is supplied from the cooling medium supply head 33 and is caused to flow inside the tubular member 12 through the cooling nozzle 30. The cooling medium is blown from the lower cooling nozzle 38 to the chillers 8. As a result, the molten metal causes directive solidification and a product having high quality can be produced. The cooling medium passing through the tubular member 12 and the cooling medium blown to the chillers 8 are gathered into the cooling medium tank 36 and are discharged outside the system through the cooling medium discharge pipe 37.

The inclining molten metal charging apparatus for forced cooling casting in accordance with the embodiment described above can automatically and accurately position the casting mold, and the tubular member, and the like, can firmly secure the casting mold during inclination and can efficiently execute forced cooling casting.

Since the weir is disposed inside the molten metal vessel, any impurities mixed in the molten metal such as slag do not mix into the product cavity of the casting mold; therefore, the quality of the product can be improved.

Although the present invention has thus been described with reference to one preferred embodiment, the invention is not particularly limited thereto but may take various other forms within the scope of the appended claims. For example, although the embodiment uses a sand mold as the casting mold, such can utilize a metal mold.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An inclining molten metal charging apparatus for forced cooling casting, comprising:

a fixed frame;

an inclining frame pivotally supported by said fixed frame and reciprocatingly inclineable by a predetermined angle and defining a space;

a stool having positioned on and fitted thereon a casting mold having a cavity, a plurality chillers disposed so as to face said cavity of said casting mold and a tubular member disposed so as to pass through said cavity and to be internally chilled;

stool support means for supporting and carrying said stool into and out of said space defined by said inclining frame;

clamp means for clamping said stool to a predetermined position inside said space, wherein said clamp means further comprises push means for pushing said casting mold towards said stool when said clamp means clamps said stool;

a molten metal vessel fixed to said inclining frame such that a molten metal inlet thereof faces a molten metal port of said casting mold, receiving said molten metal at an end of forward movement of said inclining frame and completing charge of said molten metal into said casting mold at an end of a return movement of said inclining frame;

a cooling nozzle disposed such that a tip portion thereof corresponds to an upper end of said tubular member when said stool is at said predetermined position, and which is fitted to said upper end of said tubular member by the clamping operation of said clamp means;

chiller cooling means for blowing a cooling medium to said chillers in order to cool said chillers; and a cooling medium tank for storing a cooling medium passing through said tubular member and a cooling medium blow to said chillers.

2. The inclining molten metal charging apparatus for forced cooling casting as defined in claim 1 wherein said stool support means further comprises a conveyor roller forming a moving path of said stool, a stopper butting against the front portion of said stool when said stool is carried into said space, and a plurality of guide rollers in rolling contact with both sides of said conveyor roller.

3. The inclining molten metal charging apparatus for forced cooling casting as defined in claim 2 wherein said stopper further comprises a stopper retractile with respect to said moving path.

4. The inclining molten metal charging apparatus for forced cooling casting as defined in claim 1 wherein said stool further comprises at least first and second guide pins projecting upward, and wherein said clamp means further comprises a main body supported by said inclining frame and movable up and down inside said space and a plurality of guide bushes disposed in such a manner as to correspond to said guide pins, fixed to said main body and fitting to said guide pins when said main body is moved down.

5. The inclining molten metal charging apparatus for forced cooling casting as defined in claim 1 wherein said push means further comprises a repelling spring.

6. The inclining molten metal charging apparatus for forced cooling casting as defined in claim 1 wherein said molten metal vessel further comprises slag removing means.

7. The inclining molten metal charging apparatus for forced cooling casting as defined in claim 6 wherein said slag removing means further comprises a weir disposed in proximity of said molten metal inlet.

8. The inclining molten metal charging apparatus for forced cooling casting as defined in claim 1 wherein said cooling medium tank further comprises a cooling medium discharge pipe for discharging said cooling medium outside said apparatus.

* * * * *